US006557501B2

(12) United States Patent
Hughes

(10) Patent No.: US 6,557,501 B2
(45) Date of Patent: May 6, 2003

(54) WATER HEATER HAVING FLUE DAMPER WITH AIRFLOW APPARATUS

(75) Inventor: Dennis R. Hughes, Hartford, WI (US)

(73) Assignee: AOS Holding Company, Wilmington, DE (US)

( * ) Notice: Subject to any disclaimer, the term of this patent is extended or adjusted under 35 U.S.C. 154(b) by 0 days.

(21) Appl. No.: 09/920,907

(22) Filed: Aug. 2, 2001

(65) Prior Publication Data

US 2003/0024487 A1 Feb. 6, 2003

(51) Int. Cl.[7] ..... F22B 9/18

(52) U.S. Cl. ..... 122/13.01; 122/38; 122/44.2; 122/155.1

(58) Field of Search ..... 122/4 A, 13.01, 122/38, 44.2, 155.1, 155.4, 157

(56) References Cited

U.S. PATENT DOCUMENTS

| | | | | |
|---|---|---|---|---|
| 3,638,058 A | | 1/1972 | Fritzius | |
| 3,699,387 A | | 10/1972 | Edwards | |
| 4,231,766 A | | 11/1980 | Spurgin | |
| 4,265,394 A | | 5/1981 | Nagel | |
| 4,485,746 A | | 12/1984 | Erlandsson | |
| 4,531,509 A | | 7/1985 | Wilhelm, Jr. | |
| 4,643,745 A | | 2/1987 | Sakakibara et al. | |
| 4,689,056 A | | 8/1987 | Noguchi et al. | |
| 4,770,160 A | * | 9/1988 | Schimmeyer | 126/285 A |
| 4,773,385 A | | 9/1988 | Gatling | |
| 4,789,801 A | | 12/1988 | Lee | |
| 4,812,711 A | | 3/1989 | Torok et al. | |
| 4,953,510 A | | 9/1990 | Akkala et al. | |
| 5,006,761 A | | 4/1991 | Torok et al. | |
| 5,012,159 A | | 4/1991 | Torok et al. | |
| 5,077,500 A | | 12/1991 | Torok et al. | |
| 5,180,404 A | | 1/1993 | Loreth et al. | |
| 5,239,947 A | * | 8/1993 | Schimmeyer | 122/14.1 |
| 5,255,665 A | * | 10/1993 | Windon | 122/18.31 |
| 5,495,829 A | | 3/1996 | Jayaraman et al. | |
| 5,616,995 A | | 4/1997 | Hollenbeck | |
| 5,697,330 A | * | 12/1997 | Yetman et al. | 122/14.21 |
| 5,845,632 A | * | 12/1998 | Schimmeyer | 122/13.01 |
| 5,911,217 A | | 6/1999 | Dameworth et al. | |
| 5,982,102 A | | 11/1999 | Andrzej | |
| 6,053,130 A | | 4/2000 | Shellenberger | |
| 6,401,669 B1 | | 6/2002 | Macgowan et al. | |

FOREIGN PATENT DOCUMENTS

EP 0 016 479 A2 3/1980

* cited by examiner

*Primary Examiner*—Gregory Wilson
(74) *Attorney, Agent, or Firm*—Michael Best & Friedrich LLP

(57) ABSTRACT

A water heater includes a water tank adapted to contain water; a flue extending through the water tank and having a first end communicating with the water heater's combustion chamber for the flow of products of combustion through the tank; a damper communicating with the flue; and an apparatus for creating a flow of air proximate the second end of the flue to resist the flow of warm air out of the second end of the flue due to standby convection. The apparatus for creating airflow may be a fan or an ionic wind generator. Additionally, the airflow may be directed into or across the end of the flue at the top of the water heater to either create a downdraft or an air curtain for containing warm air within the flue.

33 Claims, 3 Drawing Sheets

WATER HEATER HAVING FLUE DAMPER WITH AIRFLOW APPARATUS

BACKGROUND

The invention relates to a damper arrangement in a water heater. More specifically, the invention relates to a damper arrangement that uses an airflow apparatus to substantially reduce standby heat loss due to natural convection cycles in a water heater flue. It is known to use a damper in a water heater flue. Known dampers use a physical obstruction to close the flue during standby. One example of a physical obstruction type damper is disclosed in U.S. Pat. No. 4,953,510.

SUMMARY

The invention provides a water heater comprising a water tank adapted to contain water, a combustion chamber beneath the water tank, a burner within the combustion chamber and operable to create products of combustion, and a flue extending substantially vertically through the water tank. The flue communicates with the combustion chamber to conduct the products of combustion from the combustion chamber and to transfer heat to water stored within the water tank. The water heater also includes an airflow apparatus capable of creating airflow in the absence of any opposition to the airflow. The airflow apparatus communicates with the flue and resists standby convection flow of flue gases out of the flue when the burner is not operating.

The airflow apparatus may include a fan or an ionic wind device. The airflow apparatus may be oriented to create a downdraft within the flue or an air curtain across the top of the flue. The downdraft creates a downwardly-directed pressure within the flue that countervails upwardly-directed pressure created by standby convection cycles in the flue. The air curtain creates a flow of air across the top of the flue, which flow of air resists the flow of flue gases out of the flue when the water heater is in standby mode.

The ionic wind device includes one or more first electrodes that are preferably over the top end of the flue. A second electrode, which may be a portion of the flue itself, is spaced from the first electrodes. A power supply is interconnected between the first electrodes and the second electrode to create a voltage difference therebetween. The first electrodes ionize the air, and the second electrode attracts the ions. The ions are therefore biased for movement toward the second electrode. In the absence of an opposition to such movement of the ions, a flow of air is created by the ions as they move from the first electrodes to the second electrode. When there are flue gases present in the flue, the ions bump into flue gas particles and resist the upward movement of the flue gases out of the flue.

Other features and advantages of the invention will become apparent to those skilled in the art upon review of the following detailed description, claims, and drawings.

Figure 2:
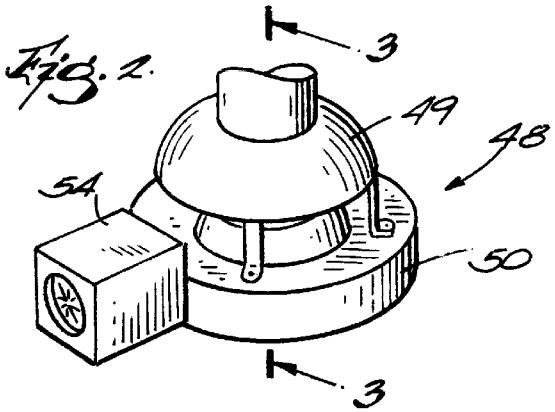
FIG. 2 is a perspective view of the damper portion of the water heater.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items. The use of "consisting of" and variations thereof herein is meant to encompass only the items listed thereafter. The use of letters to identify elements of a method or process is simply for identification and is not meant to indicate that the elements should be performed in a particular order.

DETAILED DESCRIPTION

Figure 1:
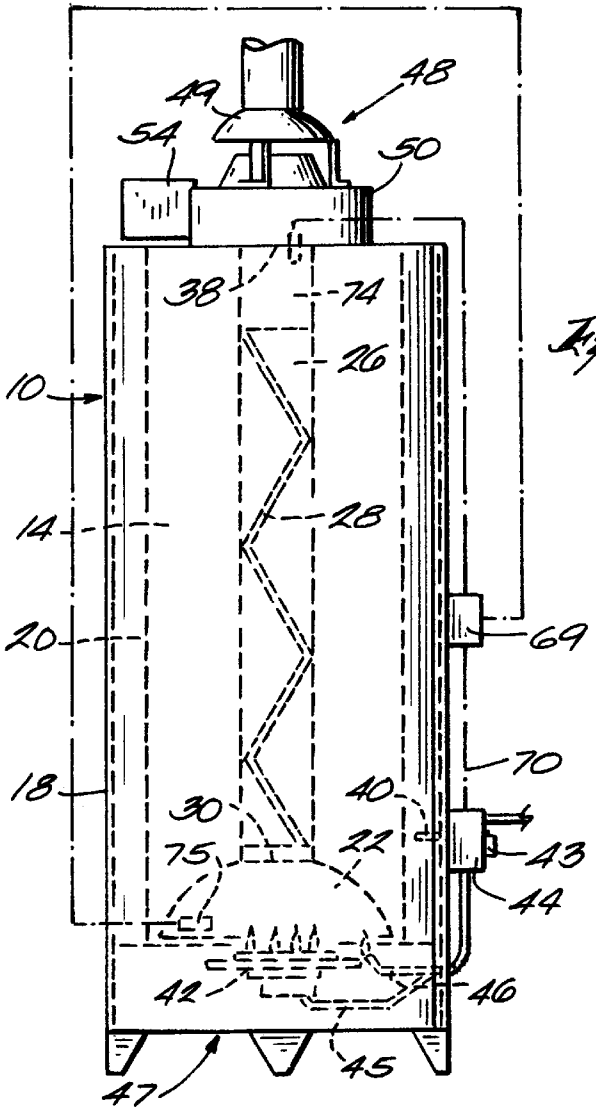
FIG. 1 is a side elevation view of a water heater embodying the present invention.

FIG. 1 illustrates a water heater 10 embodying the invention. The water heater 10 comprises a tank 14 for containing water to be heated, an outer jacket 18 surrounding the water tank 14, insulation 20 between the tank 14 and the jacket 18, a combustion chamber 22 below the tank 14, a flue 26 extending substantially vertically through the water tank 14, and a baffle 28 extending through the flue 26. The flue 26 includes a first or lower end 30, and a second or upper end 38. The water heater 10 also includes a thermostat 40 extending into the water tank 14 and a burner 42 in the combustion chamber 22. Fuel is supplied to the burner 42 through a fuel line 43, a gas valve 44, and a gas manifold tube 45. The fuel line 43 also provides fuel to a pilot burner 46 next to the burner 42. The pilot burner 46 ignites fuel flowing out of the burner 42 when the burner 42 is activated. The pilot burner 46 may be continuous such as a small flame or intermittent such as an electric spark igniter.

In operation, the burner 42 burns the fuel supplied by the fuel line 43, along with air drawn into the combustion chamber 22 through one or more air inlets 47. The burner 42 creates products of combustion that rise through the flue 26 and heat the water by conduction through the flue walls. The flow of products of combustion is driven by natural convection, but may alternatively be driven by a blower unit communicating with the flue 26. The above-described water heater 10 is well known in the art.

During standby of the water heater 10 (i.e., when the burner 42 is not operating), the air and other gases in the flue 26 (collectively, "flue gases") are heated by the water in the tank 14 and by the flame of the pilot burner 46. This creates natural convection currents and imparts a buoyancy to the flue gases that causes the flue gases to flow toward the upper end 38 of the flue 26. As used herein, "standby convection" means the natural convection within the flue 26 that occurs when the burner 42 is not operating, and that is caused by the water in the tank 14 and/or the flame of the pilot burner 46 warming the flue gases by heat transfer through the flue walls. Unrestricted flow of warm flue gases out of the flue 26 due to standby convection will result in standby heat loss from the water heater 10.

Figure 3:
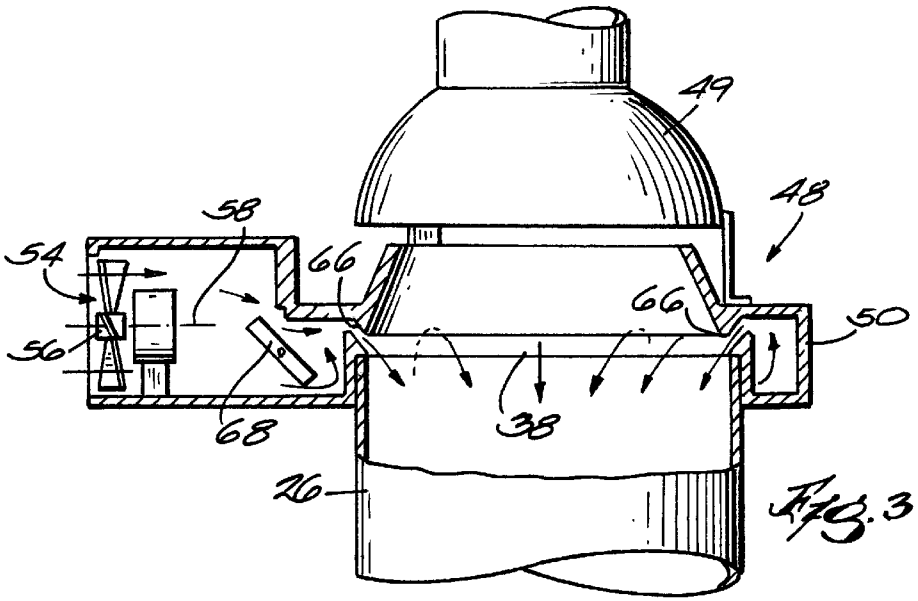
FIG. 3 is a cross-sectional view taken along line 3—3 in FIG. 2.

As seen in FIGS. 1–3, to help reduce or eliminate standby convection heat losses, the water heater 10 includes a novel damper assembly 48. The damper assembly 48 includes a hood 49, a housing 50, and an airflow apparatus 54. The hood 49 permits ambient air to mix with the products of combustion as the products of combustion pass through the damper assembly 48, and before the products of combustion are vented to the atmosphere.

As used herein, the term "airflow apparatus" means an apparatus capable of creating airflow in the absence of any opposition to the airflow. The apparatus 54 includes a tubeaxial fan 56 having rotatable blades that create a flow of air parallel to an axis of rotation 58 of the fan blades. The axis of rotation 58 is disposed horizontally, and the fan 56 is exposed to the ambient air surrounding the water heater 10 such that air is drawn into the damper assembly 48 substantially along the axis of rotation 58. The housing 50 defines an annular cavity surrounding the upper end 38 of the flue 26. Circumferential slots or apertures 66 are provided in the annular cavity, and the slots 66 are preferably angled down to direct airflow out of the annular cavity into the upper end 38 of the flue 26. With some modifications to the housing 50, the tubeaxial fan 56 may be replaced with a radial fan.

The fan 56 is preferably turned on during water heater standby, when the burner 42 is not operating. The fan 56 creates a downward pressure or back pressure zone over or within the upper end 38 of the flue 26. The fan 56 and the standby convection currents create countervailing downward and upward pressures, respectively, within the flue 26. In other words, in the absence of the fan 56, standby convection would cause the flue gases to move vertically upward out of the upper end 38 of the flue 26. In the absence of standby convection, the fan 56 would push air downwardly through the flue 26 and out of the air inlets 47.

A gate 68 is pivotably mounted in the housing 50 and is adjustable to restrict and open the air flow path from the fan 56 into the annular cavity of the housing 50. The more open the air flow path, the higher the downward pressure exerted by the fan 56 will be. Therefore, for a single-speed fan 56, the gate 68 setting determines the amount of downward pressure. Alternatively, the fan 56 may be a variable speed fan, in which case the downward pressure may be adjusted by adjusting the speed of the fan 56, and the gate 68 would not be necessary.

The water heater 10 also comprises a control system for the fan 56. With reference to FIG. 1, the control system includes a controller 69 operatively interconnected between the fan 56 and a pressure switch 70 mounted on the gas valve 44. When there is a call for heat, fuel flows through the gas valve 44 and to the burner 42. The pressure in the gas valve 44 opens the pressure switch 70, an electrical signal is relayed to the controller 69, and the controller 69 turns the fan 56 off. Alternatively, a temperature switch 74 (illustrated in broken lines in FIG. 1) may be operatively interconnected with the controller 69 and mounted at the upper end 38 of the flue 26. When the burner 42 fires, the flue gas temperature rises, thereby opening the temperature switch 74. An electrical signal is relayed to the controller 69, and the controller turns off the fan 56. Alternatively, if there is a sufficiently strong flow of products of combustion through the flue 26 during operation of the burner 42, and the fan 56 would not unduly restrict the flow of products of combustion out of the flue 26, the fan 56 may be operated at all times.

It is desirable to use as little energy as possible to drive the fan 56. More specifically, the cost of driving the fan 56 should not exceed the cost savings associated with reducing standby heat loss from the flue 26. One way to reduce the cost of driving the fan 56 is to use a thermoelectric generator 75 (illustrated in broken lines in FIG. 1) that converts heat provided by the pilot burner 46 (FIG. 1) into electricity that drives the fan 56.

FIGS. 4–8 illustrate alternative versions of the novel damper assembly 48. Where elements in these figures are the same or substantially the same as the version described above, the same reference numerals are used.

Figure 4:
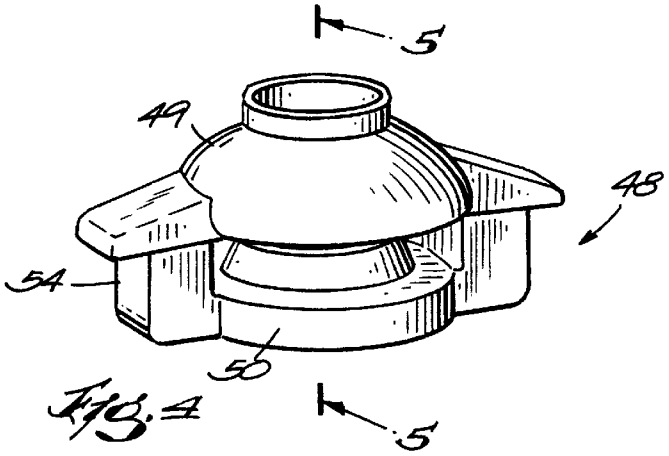
FIG. 4 is a perspective view of a second damper construction.
Figure 5:
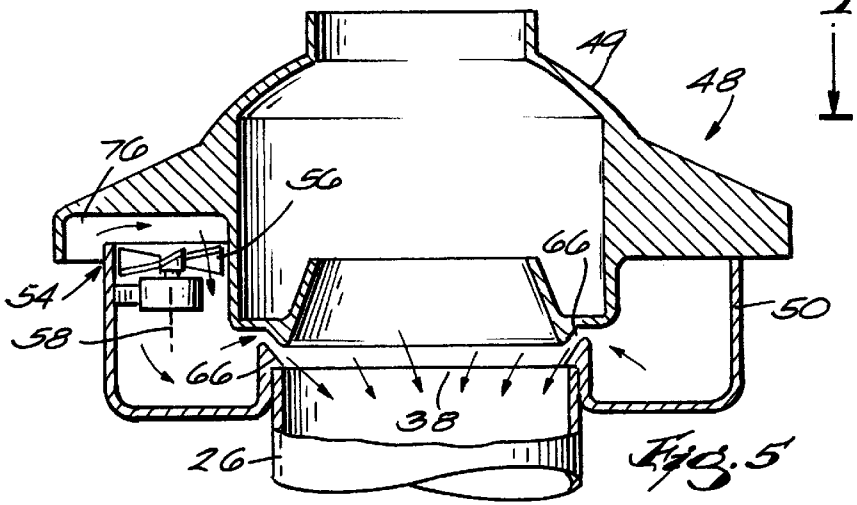
FIG. 5 is a cross-sectional view taken along line 5—5 in FIG. 4.

FIGS. 4 and 5 illustrate a second version of the damper assembly 48. In this version, the axis of rotation 58 of the tubeaxial fan 56 is vertically-oriented, and air is drawn upwardly under the hood 49 of the damper assembly 48, then downwardly through the fan 56 and into an annular cavity substantially identical to that described above. A portion of the hood 49 overhangs the fan 56 and defines a right angle entry channel 76 into the damper assembly 48. The air then follows a second right angle turn down through the fan 56, and a third right angle turn into the slots 66. The right angle turns may be slightly more or less than 90°.

The second version may also have similar control and power systems as described above, and may operate under the control of a similar controller 69. The second version may also employ a gate 68 or variable speed fan as described above with respect to the first version. As with the first version, a radial fan may be used in place of the tubeaxial fan 56 with some modifications to the housing 50. Because the fan 56 used in the first and second versions would cause a downward flow of air into the flue 26 in the absence of standby convection flow of flue gases, the first and second versions may be termed "circumferential downdraft" versions.

Figure 7:
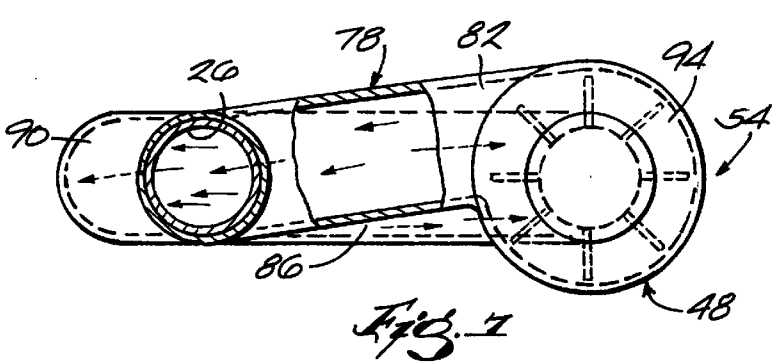
FIG. 7 is a cross-sectional view taken along line 7—7 in FIG. 6.
Figure 6:
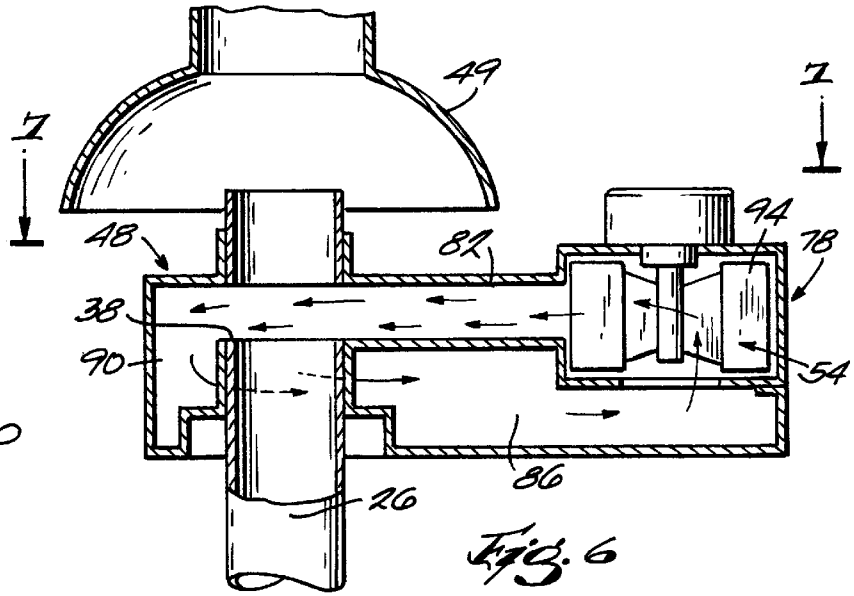
FIG. 6 is a cross-sectional view of a third damper construction.

FIGS. 6 and 7 illustrate a third version of the damper assembly 48. This version may be termed an "air curtain" version. In this version, a housing 78 is mounted to the upper end 38 of the flue 26. The housing 78 includes first and second airflow chambers or ducts 82, 86 and a turnaround chamber 90. The chambers 82, 86, 90 communicate with each other and define a loop for airflow. A radial fan or blower 94 is in the first chamber 82.

During operation of the fan 94, air is drawn and pushed by the fan 94 from the second chamber 86, through the first chamber 82, across the upper end 38 of the flue 26, into the turnaround chamber 90, and back into the second chamber 86. The resulting curtain of air flowing across the upper end 38 of the flue 26 substantially prevents the flow of warm flue gases out of the upper end 38 of the flue 26 under the influence of standby convection alone. The third version may also have similar control and power systems as described above, and may operate under the control of a similar controller 69. The radial fan 94 of this version may be replaced with a tubeaxial fan with some modifications to the housing 78.

Figures 8, 9:
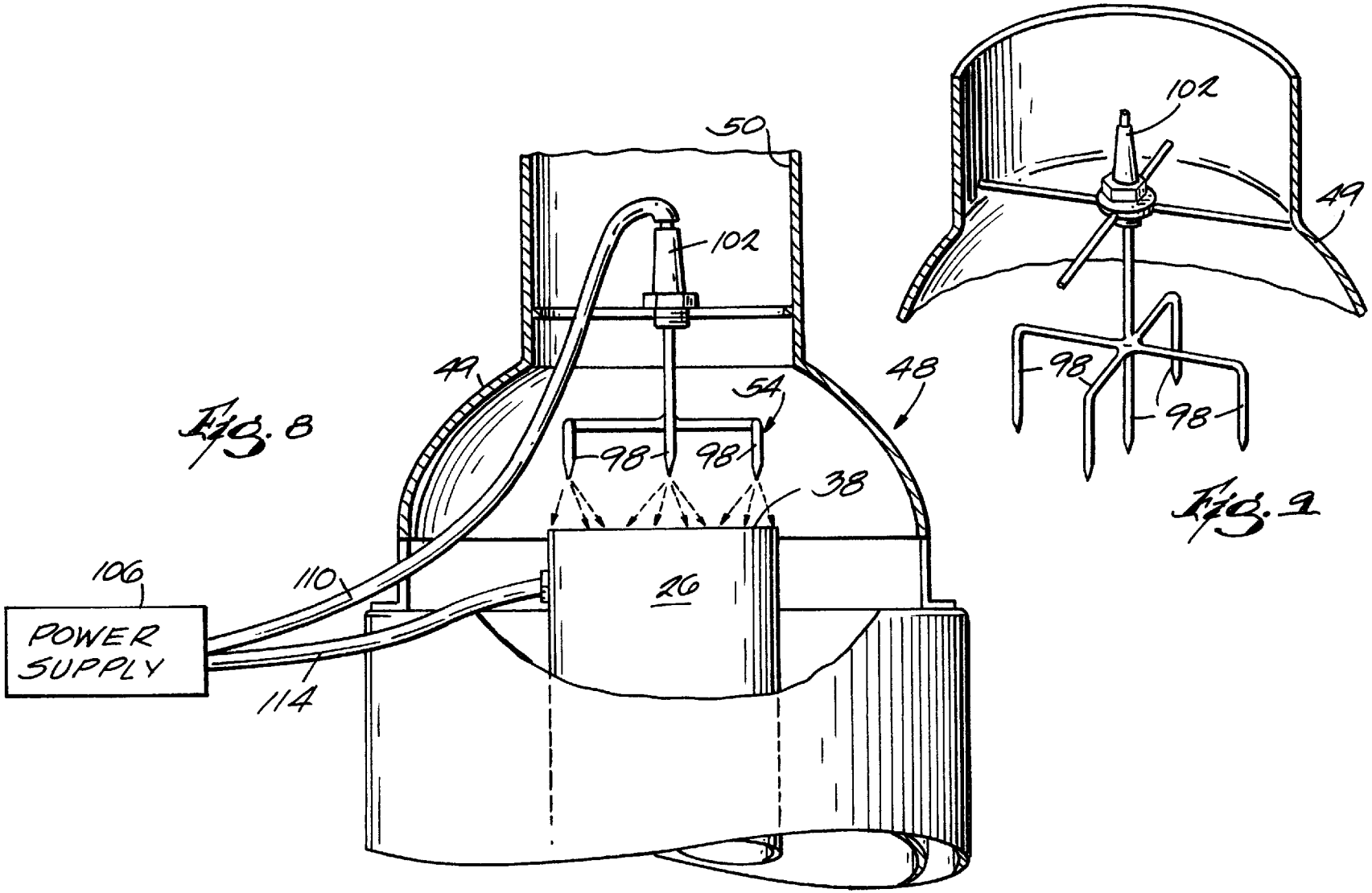
FIG. 8 is a partial section view of a fourth damper construction.
FIG. 9 is a perspective view of the electrodes of the fourth damper construction.

FIG. 8 illustrates a fourth version of the damper assembly 48. This version includes one or more first electrodes 98 having pointed ends. FIG. 9 illustrates one construction in which the first electrodes 98 include four electrodes 98 arranged in a square pattern with a fifth electrode 98 in the center of the square. It should be noted, however, that other numbers and configurations of electrodes 98 may be substituted for the illustrated arrangement.

The first electrodes 98 are connected to a device for providing electrical voltage, such as the illustrated spark plug 102. The spark plug 102 is interconnected with a power supply 106 by way of a conductive wire 110. It is preferable to supply DC power to the first electrodes 98, and the power supply 106 may therefore be a DC power source or an AC power source with a DC converter or an AC signal imposed on a DC power source. The power supply 106 is grounded to the flue wall by way of a grounding wire 114, and therefore a portion of the flue wall acts as a second electrode having a polarity opposite the first electrodes 98. There is therefore a high voltage difference between the first electrodes 98 and the flue wall. A voltage difference of 8–10 kV is preferable, but it may also be higher.

When the power supply 106 is actuated, a positive charge is applied to the first electrodes 98. The positive charge ionizes particles in the air around the first electrodes 98, and the ionized particles are drawn or attracted to the oppositely-charged flue wall. The pointed ends of the first electrodes 98 facilitate the creation of the ionized particles, and the relatively large size of the second electrode (i.e., the flue 26) ensures that the ionized particles will be attracted to the second electrode. The ionized particles are therefore biased for movement toward the flue wall, and bump into flue gas particles in or exiting the upper end 38 of the flue 26. This creates a downward pressure on the flue gases that substantially prevents the flue gases from escaping through the upper end 38 of the flue 26. The fourth Version may therefore also be considered a downdraft damper.

Alternatively, the first electrodes 98 may be positioned to the side of the upper end 38 of the flue 26 and a second electrode or electrodes may be positioned on the other side of the upper end 38 such that a cross-flow of ionic wind is created across the upper end 38, resulting in an air curtain similar to that described above in the third version. The fourth version may also have similar control system as described above, and may operate under the control of a similar controller 69.

It should be noted that all versions of the illustrated apparatus for creating airflow are able to substantially prevent the flow of flue gases out of the flue 26 under the influence of standby convection without the use of a physical obstruction (e.g., a conventional solid damper valve) being placed over the upper end 38 of the flue 26.

What is claimed is:

1. A water heater comprising:

a water tank adapted to contain water;

a combustion chamber beneath the water tank;

a burner within said combustion chamber and operable to create products of combustion;

a flue extending substantially vertically through said water tank and communicating with said combustion chamber to conduct the products of combustion from said combustion chamber and to transfer heat to water stored within said water tank; and an airflow apparatus capable of creating airflow in the absence of any opposition to the airflow, the airflow having a pressure, said airflow apparatus communicating with said flue and operable such that the pressure of the airflow resists standby convection flow of flue gases out of said flue when said burner is not operating.

2. The water heater of claim 1, wherein said airflow apparatus includes a fan capable of rotating to create airflow, said fan being selectively actuable to create a positive downward pressure within said flue to resist vertical standby convection flow.

3. The water heater of claim 1, further comprising a housing proximate an upper end of said flue, said housing defining an annular chamber around said upper end, said housing including at least one aperture communicating between said annular chamber and said flue, wherein said airflow apparatus includes a fan communicating with said annular chamber and actuable to create a downward pressure within said flue through said at least one aperture to resist vertical standby convection flow.

4. The water heater of claim 1, wherein said airflow apparatus includes a radial fan.

5. The water heater of claim 1, further comprising a fuel supply communicating with said burner and a pressure sensor exposed to said fuel supply, said pressure sensor selectively activating and deactivating said airflow apparatus in response to changes in pressure in said fuel supply.

6. The water heater of claim 1, further comprising a temperature sensor exposed to flue gases within said flue, said temperature sensor activating and deactivating said airflow apparatus in response to changes in temperature within said flue.

7. The water heater of claim 1, further comprising a pilot burner proximate said burner within said combustion chamber, and a power generator converting heat from said pilot burner into electricity for powering said airflow apparatus.

8. The water heater of claim 1, wherein said airflow apparatus does not create a physical obstruction to said flue.

9. A water heater comprising:

a water tank adapted to contain water;

a combustion chamber beneath the water tank;

a burner within said combustion chamber and operable to create products of combustion;

a flue extending substantially vertically through said water tank and communicating with said combustion chamber to conduct the products of combustion from said combustion chamber and to transfer heat to water stored within said water tank; and an airflow apparatus capable of creating airflow in the absence of any opposition to the airflow, said airflow apparatus communicating with said flue and operable to resist standby convection flow of flue gases out of said flue when said burner is not operating, wherein said airflow apparatus directs a flow of air across an upper end of said flue, thereby creating a curtain of air that resists standby convection flow of flue gases out of said flue.

10. The water heater of claim 9, further comprising a housing around the upper end of said flue, wherein said housing includes first and second flow chambers communicating with each other and a turn-around flow chamber communicating between said first and second flow chambers, wherein said airflow apparatus causes air to flow through said first flow chamber across said upper end of said flue to create an air curtain over said upper end, wherein said turn-around flow chamber redirects the flow of air from said first flow chamber into said second flow chamber, and wherein said second flow chamber returns the flow of air to said first flow chamber.

11. A water heater comprising:

a water tank adapted to contain water;

a combustion chamber beneath the water tank;

a burner within said combustion chamber and operable to create products of combustion;

a flue extending substantially vertically through said water tank and communicating with said combustion chamber to conduct the products of combustion from said combustion chamber and to transfer heat to water stored within said water tank; and an airflow apparatus capable of creating airflow in the absence of any opposition to the airflow, said airflow apparatus communicating with said flue and operable to resist standby convection flow of flue gases out of said flue when said burner is not operating, wherein said airflow apparatus includes at least one first electrode proximate an upper end of said flue, and a second electrode having a polarity opposite that of said first electrode and spaced from said first electrode, said water heater further comprising a power source interconnected between said at least one first electrode and said second electrode to create a voltage difference therebetween, said at least one first electrode creating ions, said ions being biased for movement toward said second electrode to create a downward pressure within said flue to resist vertical standby convection flow of flue gases.

12. The water heater of claim 11, wherein said power source provides DC power to said electrodes.

13. The water heater of claim 11, wherein said second electrode includes a portion of said flue.

14. A water heater comprising:

a tank adapted to contain water;

a flue extending substantially vertically through said tank;

a combustion chamber below said tank and communicating with said flue;

a burner within said combustion chamber and adapted to combust a flammable substance to create products of combustion, the products of combustion passing through said water tank in said flue and heating the water in said tank through said flue, said water heater being in a standby mode when said burner is turned off, the water in said tank heating flue gases within said flue during standby mode and imparting a buoyancy to the flue gases to bias the flue gases upward through the flue; and an air biasing mechanism proximate the top of said flue and operable to create a downward biasing force within said flue, said air biasing mechanism not creating a physical obstruction in the top of said flue;

wherein said biasing force created by said air biasing mechanism countervails the buoyancy of the flue gases to substantially prevent flow of flue gases out of said flue during standby mode.

15. The water heater of claim 14, wherein said air biasing mechanism includes an air mover capable of moving a volume of air in the absence of an opposition to such air movement, and wherein the buoyant flue gases provide an obstruction to such air movement during water heater standby, such that the air biasing mechanism and the buoyant flue gases offset each other to create a substantially stagnant state within the flue during water heater standby.

16. The water heater of claim 14, further comprising a housing surrounding the top of the flue, said housing defining an annular chamber and at least one slot communicating between said annular chamber and said flue, said at least one slot being angled downwardly toward the top of said flue to direct air from said air biasing mechanism into the top of the flue.

17. The water heater of claim 14, wherein said air biasing mechanism includes a fan.

18. The water heater of claim 14, wherein said air biasing mechanism includes first and second spaced-apart electrodes having opposite polarity, said first electrode ionizing air and said second electrode attracting ions created by said first electrode.

19. The water heater of claim 18, wherein said first electrode includes a plurality of electrodes and wherein said second electrode includes a portion of said flue.

20. A method for operating a water heater in an energy efficient manner, the water heater including a water tank, a combustion chamber beneath the water tank, a burner within the combustion chamber, and a flue that communicates with the combustion chamber and extends substantially vertically through the tank, the method comprising:

combusting a fuel with the burner to create hot products of combustion that flow up through the flue and heat the water;

venting the products of combustion from the water heater through the upper end of the flue;

putting the water heater in standby mode by shutting down the burner once the water in the tank has reached a desired temperature, wherein the water in the tank heats flue gases within the flue while the water heater is in standby mode to create standby convection currents within the flue, the standby convection currents causing an upward flow of flue gases if not resisted;

positioning an airflow apparatus proximate the upper end of the flue, the airflow apparatus being capable of creating airflow in the absence of any opposition to the airflow; and resisting the upward flow of standby convection currents within the flue by selective actuation of the airflow apparatus.

21. The method of claim 20, further comprising maintaining the upper end of the flue free from physical obstructions.

22. The method of claim 20, wherein the standby convection currents create an upwardly-directed pressure within the flue, wherein the act of positioning an airflow apparatus includes positioning a fan proximate the upper end of the flue, and wherein the act of resisting upward flow includes operating the fan to create a downwardly-directed pressure countervailing the upwardly-directed pressure.

23. The method of claim 22, wherein the act of positioning an airflow apparatus further includes:

positioning a housing around the upper end of the flue, the housing defining an annular chamber communicating with the fan; and providing an aperture in the housing communicating between the annular chamber and the upper end of the flue, the aperture being angled downwardly toward the upper end of the flue;

wherein the downwardly-directed pressure is applied through the aperture.

24. The method of claim 20, wherein the act of positioning an airflow apparatus includes positioning at least one first electrode proximate the upper end of the flue and positioning a second electrode within the flue, and wherein the act of resisting upward flow includes applying a voltage difference between the first and second electrodes to create ions and bias the ions for movement toward the second electrode to create a downwardly-directed pressure countervailing an upwardly-directed pressure created by the standby convection currents.

25. The method of claim 24, wherein the act of resisting upward flow includes providing a DC power source and attaching the power source to the first electrode and to the flue such that a portion of the flue acts as the second electrode.

26. The method of claim 20, further comprising providing fuel to the burner with a fuel conduit, exposing a pressure sensor to the fuel in the fuel conduit, and wherein the act of resisting the upward flow includes selectively actuating the airflow apparatus in response to fuel pressure sensed by the pressure sensor.

27. The method of claim 20, further comprising providing a temperature sensor, exposing the temperature sensor to flue gases within the flue, and selectively activating the airflow apparatus in response to changes in temperature within the flue sensed with the temperature sensor.

28. A water heater comprising:

a tank adapted to contain water;

a combustion chamber beneath said tank;

a flue communicating with said combustion chamber and extending through said tank;

a burner within said combustion chamber, said water heater being in a standby mode when said burner is turned off, wherein flue gases within said flue are biased by convection to flow upwardly through said flue when said water heater is in standby mode;

at least one first electrode proximate an upper end of said flue;

at least one second electrode spaced from said at least one first electrode; and a power supply interconnected with both said first and second electrode and creating a voltage difference therebetween, wherein said first electrode is adapted to create ions in the air surrounding said first electrode, wherein said second electrode is adapted to attract the ions, wherein the direction of ionic attraction is substantially opposite the direction of bias of the flue gases when said water heater is in standby mode, and wherein said ions and said flue gases create countervailing pressures within said flue to reduce heat loss from said flue when said water heater is in standby mode.

29. The water heater of claim 28, wherein said at least one electrode includes a pointed tip to facilitate the formation of ions.

30. The water heater of claim 28, wherein said at least one first electrode includes five first electrodes.

31. The water heater of claim 30, wherein four of said first electrodes are at the corners of a square pattern and the fifth first electrode is in the center of said square pattern, and wherein said five first electrodes are oriented substantially parallel to each other.

32. The water heater of claim 28, wherein said second electrode includes a portion of said flue.

33. The water heater of claim 28, wherein said power supply provides DC power to said first and second electrodes.

* * * * *